US008182248B2

(12) United States Patent
Cygnor

(10) Patent No.: US 8,182,248 B2
(45) Date of Patent: May 22, 2012

(54) VANE PUMP WITH TILTING PAD RADIAL BEARINGS

(75) Inventor: John E. Cygnor, Winnebago, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 897 days.

(21) Appl. No.: 12/243,345

(22) Filed: Oct. 1, 2008

(65) Prior Publication Data

US 2009/0142215 A1 Jun. 4, 2009

Related U.S. Application Data

(60) Provisional application No. 60/990,934, filed on Nov. 29, 2007.

(51) Int. Cl.

| | |
|---|---|
| ***F01C 1/00*** | (2006.01) |
| ***F04C 2/00*** | (2006.01) |
| ***F16C 32/06*** | (2006.01) |
| ***F16C 17/00*** | (2006.01) |

(52) U.S. Cl. ..... 418/30; 418/22; 418/24; 418/225; 384/122; 384/309

(58) Field of Classification Search ..... 418/22, 418/24, 30, 225; 384/122, 309
See application file for complete search history.

(56) References Cited

U.S. PATENT DOCUMENTS

| | | | | |
|---|---|---|---|---|
| 5,634,725 | A * | 6/1997 | Chester | 384/122 |
| 6,089,754 | A * | 7/2000 | Wilkes et al. | 384/122 |
| 6,200,034 | B1 * | 3/2001 | Miller | 384/309 |
| 8,047,824 | B2 * | 11/2011 | Boskovic et al. | 418/133 |
| 2004/0136853 | A1 * | 7/2004 | Clements et al. | 418/24 |
| 2006/0099100 | A1 * | 5/2006 | Clements et al. | 418/173 |
| 2010/0166588 | A1 * | 7/2010 | Heitz et al. | 418/22 |

* cited by examiner

*Primary Examiner* — Mary A Davis
(74) *Attorney, Agent, or Firm* — Stephen G. Mican

(57) ABSTRACT

A vane pump comprises: a drive shaft that passes through the pump frame; a rotor coupled to the drive shaft that has multiple vanes and rotates within the pump frame in an axial direction about an axis of rotation with an outer rotor surface that has a radius that extends from the axis of rotation; a cam ring within the pump frame that circumscribes the rotor and vanes with a cam ring inner surface; multiple radial tilting pad bearings that support the cam ring; a bearing support ring coupled to the pump frame that generally circumscribes the cam ring and mounts the radial tilting pad bearings; side plates that radially extend from the drive shaft to the pump frame to enclose the rotor and the cam ring with at least one side plate having an inlet port and an outlet port; and means for initiating rotation of the cam ring from rest.

19 Claims, 2 Drawing Sheets

VANE PUMP WITH TILTING PAD RADIAL BEARINGS

CROSS REFERENCE TO RELATED APPLICATIONS

This Application relates to the subject matter described in Provisional Patent Application Ser. No. 60/990,934 filed 29 Nov. 2007 and claims the benefit of the filing date there for.

FIELD OF THE INVENTION

The invention relates to a vane pump, and more particularly to a vane pump with reduced internal frictional loss.

BACKGROUND OF THE INVENTION

The primary source of frictional loss in a vane pump, whether it is a fixed or variable displacement type, is friction between its vane tips and a mating inner surface of its stationary cam ring. This frictional loss manifests itself as generated heat that transfers directly into pumped fluid. In aeronautical applications, a vane pump may serve as a fuel pump for a gas turbine engine, in which case the pumped fuel may serve as a heat sinking cooling medium for auxiliary systems, such as lubrication systems, fuel powered actuation systems and electronic control systems. Transfer of generated heat to the fuel due to frictional loss in the pump reduces the heat sink capacity of the fuel for cooling such auxiliary systems.

One type of vane pump overcomes such vane-cam ring frictional loss to some degree by forming the outer surface of the cam ring into a journal that fits in a bearing. The bearing pivots about a pin attached to a housing for the pump to allow variable displacement of the pump. However, the relatively large surface area of the journal bearing still induces significant frictional loss.

SUMMARY OF THE INVENTION

The invention generally comprises a vane pump comprising: a drive shaft that passes through the pump frame; a rotor coupled to the drive shaft that has multiple vanes and rotates within the pump frame in an axial direction about an axis of rotation with an outer rotor surface that has a radius that extends from the axis of rotation; a cam ring within the pump frame that circumscribes the rotor and vanes with a cam ring inner surface; multiple radial tilting pad bearings that support the cam ring; a bearing support ring coupled to the pump frame that generally circumscribes the cam ring and mounts the radial tilting pad bearings; side plates that radially extend from the drive shaft to the pump frame to enclose the rotor and the cam ring with at least one side plate having an inlet port and an outlet port; and means for initiating rotation of the cam ring from rest.

DETAILED DESCRIPTION OF THE INVENTION

Figure 1:
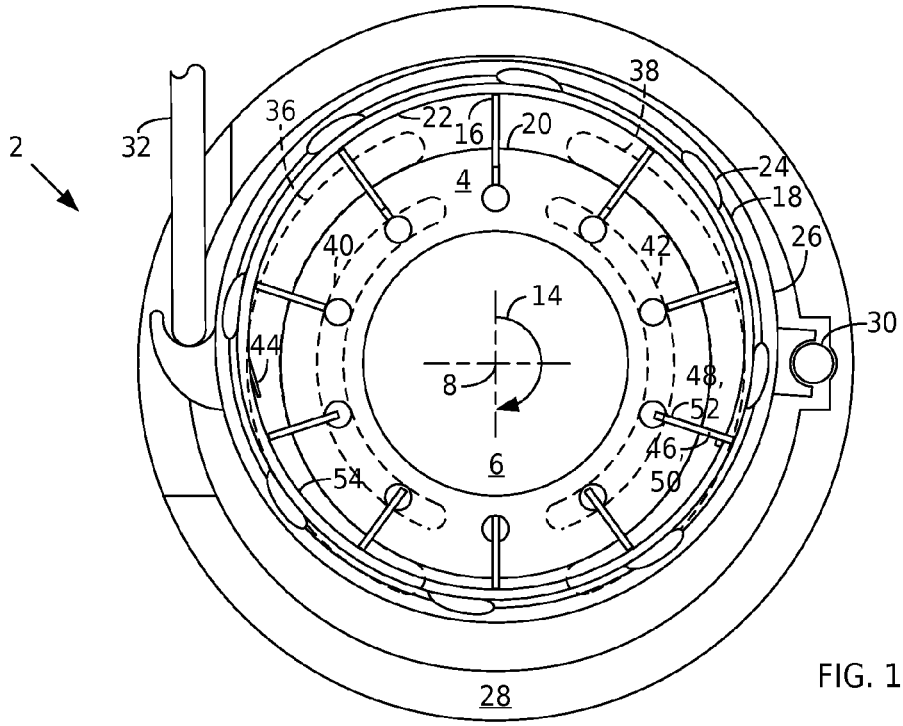
FIG. 1 is a partial cut-away front view of a variable displacement vane pump (VSVP) 2 according to a possible embodiment of the invention.
Figure 2:
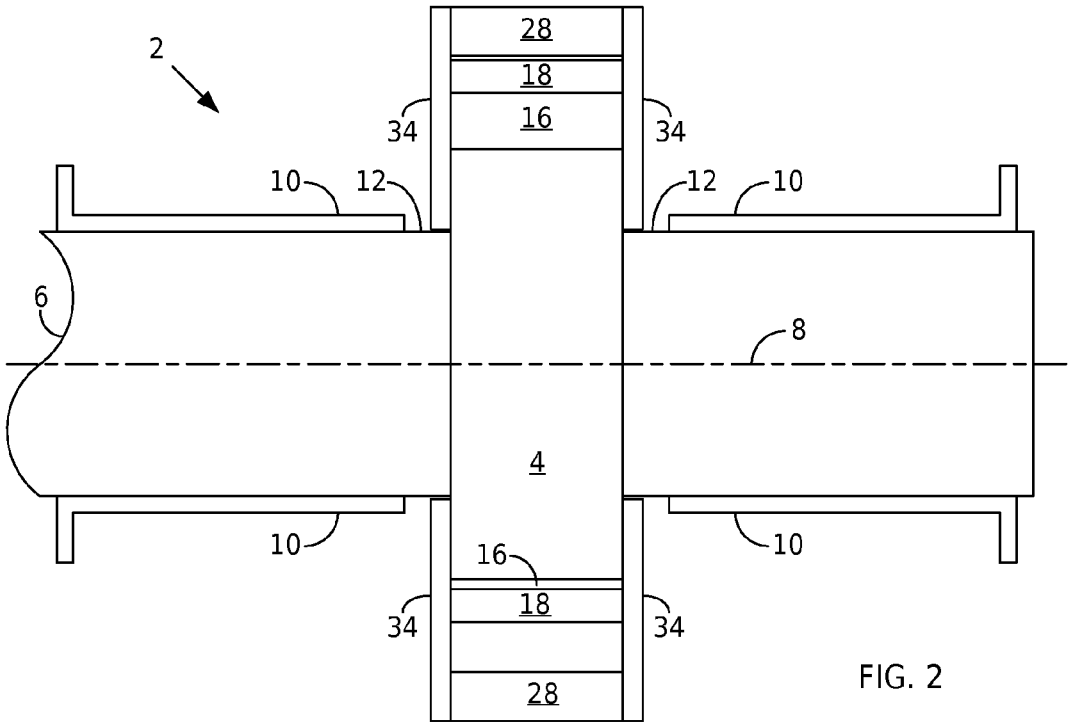
FIG. 2 is a partial cut-away side view of a variable displacement vane pump according to a possible embodiment of the invention.

FIGS. 1 and 2 are respective partial cut-away front and side views of a variable displacement vane pump (VDVP) 2 according to a possible embodiment of the invention. Referring to FIGS. 1 and 2 together, the pump 2 has a rotor 4 coupled to a drive shaft 6 that has an axis of rotation 8. Bearings 10 support journals 12 along the drive shaft 6 that allow the drive shaft 6 with its coupled rotor 4 to rotate about the axis of rotation 8 in an angular direction 14. The rotor 4 has multiple vanes 16 that protrude generally radially outward toward a cam ring 18 that circumscribes the rotor 4, with the vanes 16 extending from an outer surface 20 of the rotor 4 to an inner surface 22 of the cam ring 18.

According to a possible embodiment of the invention, multiple radial tilting pad bearings 24 support the cam ring 18. A bearing support ring 26 that generally circumscribes the cam ring 18 mounts the radial tilting pad bearings 24. A pump frame 28 generally circumscribes the bearing support ring 26 and the bearing support ring 26 pivots within the pump frame 28 about a bearing support ring pivot 30 by means of an actuator 32. Side plates 34 extend radially from the drive shaft 6 along the radially extending sides of the rotor 4, the cam ring 18 and the bearing support ring 26 to the pump frame 28 to enclose the rotor 4, the cam ring 18 and the bearing support ring 26. One or both side plates 34 may have an inlet port 36 and an outlet port 38. One or both side plates 34 may also have an under vane inlet port 40 and an under vane outlet port 42.

The radial tilting pad bearings 24 that support the cam ring 18 allow the cam ring 18 to rotate freely. The boundary friction between the vanes 16 and the cam ring 18 will rotate the cam ring 18 at an angular velocity that is generally synchronous with the vanes 16, thereby essentially eliminating vane-cam ring frictional loss. The radial tilting pad bearings 24 generate a low friction full fluid film that supports the cam ring 18 and this prevents significant friction-induced power loss due to rotation of the cam ring 18.

Ideally, from rest the vane-cam ring friction would bring the cam ring 18 up to speed with the vanes 16 both to reduce vane-cam ring friction and to achieve full fluid film lubrication regime between the cam ring 18 and the radial tilting pad bearings 24. However, in practice, the vane-cam ring friction may be insufficient to do so. Therefore, it is desirable to add some means for initiating rotation of the cam ring 18 from rest to establish such full film lubrication between the cam ring 18 and the radial tilting pad bearings 24. One possible device for initiating rotation of the cam ring 18 from rest is at least one flexible finger 44 that protrudes obliquely outward from the cam ring inner surface 22. The flexible finger 44 may engage a vane 16 upon start-up of the pump 2 yet compress to rest flat against the cam ring inner surface 22 when the cam ring inner surface 22 meets the rotor outer surface 20 as the cam ring 18 and the rotor 4 rotate. Other possible devices for initiating rotation of the cam ring 18 from rest may be at least one cam ring drive link 46 adjacent to one of the vanes 16 that engages a slot 48 in the rotor outer surface 22 or at least one radial pin 50 in the cam ring outer surface 22 that engages a hole 52 in the rotor outer surface 20. Another possible device for initiating rotation of the cam ring 18 may be a surface treatment 54 to the cam ring outer surface 22.

Figure 3:
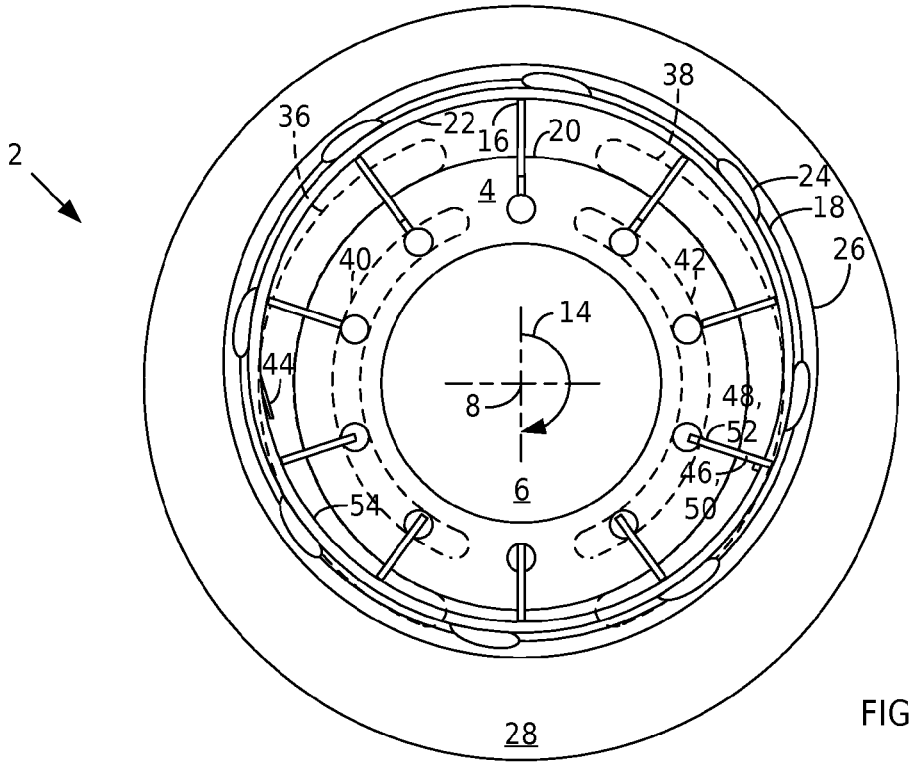
FIG. 3 is a partial cut-away front view of a fixed displacement vane pump (VSVP) according to another possible embodiment of the invention.

Although FIGS. 1 and 2 illustrate the pump 2 as a variable displacement vane pump, the pump 2 may alternatively comprise a fixed displacement pump as shown in FIG. 3, wherein the bearing support ring 26 mounts in a fixed position within the pump frame 28. In this case, the pump 2 will have no bearing support ring pivot 30 or actuator 32. The described embodiment of the invention is only an illustrative implementation of the invention wherein changes and substitutions of the various parts and arrangement thereof are within the scope of the invention as set forth in the attached claims.

The claimed invention is:

1. A vane pump comprising:

a drive shaft that passes through a pump frame;

a rotor coupled to the drive shaft that has multiple vanes and rotates within the pump frame in an axial direction about an axis of rotation with an outer rotor surface that has a radius that extends from the axis of rotation;

a cam ring within the pump frame that circumscribes the rotor and multiple vanes with a cam ring inner surface;

multiple radial tilting pad bearings that support the cam ring;

a bearing support ring coupled to the pump frame that circumscribes the cam ring and mounts the radial tilting pad bearings;

side plates that radially extend from the drive shaft to the pump frame to enclose the rotor and the cam ring with at least one of the side plates having an inlet port and an outlet port; and a device for initiating rotation of the cam ring from rest.

2. The vane pump of claim 1, wherein the vane pump is of a variable displacement pump and the bearing support ring pivots within the pump frame about a bearing support ring pivot between a maximum displacement position and a minimum displacement position.

3. The vane pump of claim 2, further comprising an actuator for pivoting the bearing support ring about the bearing support ring pivot.

4. The vane pump of claim 1, wherein the vane pump is a fixed displacement pump and the bearing support ring mounts in a fixed position within the pump frame.

5. The vane pump of claim 1, wherein the device for initiating rotation comprises at least one flexible finger that protrudes obliquely outward from the cam ring inner surface.

6. The vane pump of claim 1, wherein the device for initiating rotation comprises at least one cam ring drive link adjacent to one of the multiple vanes that engages a slot in the rotor outer surface.

7. The vane pump of claim 1, wherein the device for initiating rotation comprises at least one radial pin in the cam ring outer surface that engages a hole in the rotor outer surface.

8. The vane pump of claim 1, wherein the device for initiating rotation comprises a surface treatment to the cam ring inner surface.

9. A variable displacement vane pump comprising:

a drive shaft that passes through a pump frame;

a rotor coupled to the drive shaft that has multiple vanes and rotates within the pump frame in an axial direction about an axis of rotation with an outer rotor surface that has a radius that extends from the axis of rotation;

a cam ring within the pump frame that circumscribes the rotor and multiple vanes with a cam ring inner surface;

multiple radial tilting pad bearings that support the cam ring;

a bearing support ring that circumscribes the cam ring, mounts the radial tilting pad bearings and pivots within the pump frame about a bearing support ring pivot between a maximum displacement position and a minimum displacement position;

side plates that radially extend from the drive shaft to the pump frame to enclose the rotor and the cam ring with at least one of the side plates having an inlet port and an outlet port; and a device for initiating rotation of the cam ring from rest.

10. The variable displacement vane pump of claim 9, further comprising an actuator for pivoting the bearing support ring about the bearing support ring pivot.

11. The variable displacement vane pump of claim 9, wherein the device for initiating rotation comprises at least one flexible finger that protrudes obliquely outward from the cam ring inner surface.

12. The variable displacement vane pump of claim 9, wherein the device for initiating rotation comprises at least one cam ring drive link adjacent to one of the multiple vanes that engages a slot in the rotor outer surface.

13. The variable displacement vane pump of claim 9, wherein the device for initiating rotation comprises at least one radial pin in the cam ring inner surface that engages a hole in the rotor outer surface.

14. The variable displacement vane pump of claim 9, wherein the device for initiating rotation comprises a surface treatment to the cam ring inner surface.

15. A fixed displacement vane pump comprising:

a drive shaft that passes through a pump frame;

a rotor coupled to the drive shaft that has multiple vanes and rotates within the pump frame in an axial direction about an axis of rotation with an outer rotor surface that has a radius that extends from the axis of rotation;

a cam ring within the pump frame that circumscribes the rotor and multiple vanes with a cam ring inner surface;

multiple radial tilting pad bearings that support the cam ring;

a bearing support ring mounted in a fixed position to the pump frame that circumscribes the cam ring and mounts the radial tilting pad bearings;

side plates that radially extend from the drive shaft to the pump frame to enclose the rotor and the cam ring with at least one of the side plates having an inlet port and an outlet port; and a device for initiating rotation of the cam ring from rest.

16. The fixed displacement vane pump of claim 15, wherein the device for initiating rotation comprises at least one flexible finger that protrudes obliquely outward from the cam ring inner surface.

17. The fixed displacement vane pump of claim 15, wherein the device for initiating rotation comprises at least one cam ring drive link adjacent to one of the multiple vanes that engages a slot in the rotor outer surface.

18. The fixed displacement pump of claim 15, wherein the device for initiating rotation comprises at least one radial pin in the cam ring outer surface that engages a hole in the rotor outer surface.

19. The fixed displacement vane pump of claim 15, wherein the device for initiating rotation comprises a surface treatment to the cam ring inner surface.

* * * * *